US005772510A

United States Patent [19]

Roberts

[11] Patent Number: 5,772,510

[45] Date of Patent: Jun. 30, 1998

[54] LOTTERY TICKET AND SYSTEM

[75] Inventor: Brian J. Roberts, Carlsbad, Calif.

[73] Assignee: Loto Mark Incorporated, East Providence, R.I.

[21] Appl. No.: 548,494

[22] Filed: Oct. 26, 1995

[51] Int. Cl.[6] ..... A63F 3/06

[52] U.S. Cl. ..... 463/17; 463/42; 273/139; 273/138.2

[58] Field of Search ..... 463/17, 18, 16, 463/42; 273/139, 138.2

[56] References Cited

U.S. PATENT DOCUMENTS

| | | | |
|---|---|---|---|
| 4,087,092 | 5/1978 | Krause et al. | 463/17 |
| 4,157,829 | 6/1979 | Goldman et al. | 463/42 |
| 4,677,553 | 6/1987 | Roberts et al. | 463/17 |
| 5,129,652 | 7/1992 | Wilkinson | 273/139 |

OTHER PUBLICATIONS

"Blockbuster Video $20 Million Win In A Flash Game", Blockbuster Entertainment Corporation, 1991.

*Primary Examiner*—Benjamin H. Layno
*Attorney, Agent, or Firm*—Fish & Richardson P.C.

[57] ABSTRACT

A non-completed lottery ticket having a blank region adapted for having printed therein information necessary to complete the ticket. The necessary information includes "play data" used to determine the win/lose outcome of the ticket, either "instantly" or at a future date. A lottery ticket having a first number concealed with a removable material and a blank region adapted for having printed thereon a second number, the first and second numbers indicating the win/lose outcome of the ticket. A method for providing completed lottery tickets comprising the steps of: storing a partially printed, non-completed lottery ticket; providing a terminal coupled to a remotely located computer; and, inserting the non-completed lottery ticket into the terminal and having the terminal communicate with the remotely located computer, the computer supplying to the terminal ticket completion information and such terminal then printing such computer supplied ticket completion information onto the non-completed lottery ticket to provide the purchaser with the completed lottery ticket. Also disclosed is a system for dispensing completed lottery tickets from a vending machine. The vending machine stores partially printed, non-completed lottery tickets. When a lottery ticket is purchased from the vending machine, a printer in the vending machine prints ticket completion information on the stored, non-completed lottery ticket to thereby provide the purchaser with a completed lottery ticket.

33 Claims, 9 Drawing Sheets

2. PROCESSES TICKET BY TERMINAL 14

3. TICKET WITH ALL NUMBERS EXPOSED

1. PRE-PRINTED TICKET

2. PROCESSES TICKET BY TERMINAL 14

3. TICKET WITH
ALL NUMBERS EXPOSED

AFTER PROCESSING

BEFORE PROCESSING

LOTTERY TICKET AND SYSTEM

BACKGROUND OF THE INVENTION

This invention relates generally to lottery tickets and systems and more particularly to a system for providing completed lottery tickets.

As is known in the art, lottery tickets are sold in a variety of ways. One way is over-the-counter and, more recently, through vending machines. In both cases, the lottery tickets in the store or in the vending machine are completed lottery tickets. Therefore, because the lottery tickets shipped to, and stored in the stores are already completed, a secure printing, packaging, and distribution process is required. This is particularly true in the case of the so-called "instant ticket". An "instant ticket" is one having "play data" (i.e., bells, cherries, bars, etc. To determine a prize) printed on the ticket, but concealed with a "scratch-off", or "rub-off" material. After purchase, the purchaser removes the concealing "rub-off" material to expose the "play data" and from such data determines the prize, if any.

Completed lottery tickets are valuable and are therefore subject to theft. Further, in the case of the "instant" ticket, in order to prevent a non-purchaser in possession of the ticket from discovering the concealed "play data", as with some type of infrared scanner or by attempting to see through the "rub-off" material or by other various ways of compromising the "play data" of the ticket, the lottery ticket is printed on a relatively expensive foil material or a costly recyclable secure card stock.

As is also known in the art, lottery ticket terminals are sometimes used by a clerk to provide a customer purchases a completed lottery ticket. For example, the purchaser provides information to the clerk who then enters the information into a terminal coupled to a remotely located lottery organization computer. The computer then causes the terminal to print a completed lottery ticket. With such arrangement, however, because the clerk must enter the information into the terminal, other customers in-line who may be purchasing non-lottery ticket items, must wait for the lottery ticket purchase to be completed before they can check-out.

As noted above, in some cases the completed lottery tickets are sold through vending machines. Upon receipt of the purchase price, the vending machine dispenses one of its stored, completed lottery tickets. One advantage of a vending machine is that lottery tickets can be purchased without requiring the assistance of a behind-the-counter clerk. Furthermore, the vending machine need not be located at the check-out counter but may be located inside the store but away from the check-out counter to expedite traffic and sell more tickets. Further, the vending machines may be located in a kiosk at a mall or airport, for example. Unfortunately, the owner of the vending machine, particularly one located in the kiosk, runs the risk that it, along with its completed lottery tickets, may be stolen.

SUMMARY OF THE INVENTION

With this background of the invention in mind, it is therefore an object of this invention to provide an improved lottery ticket.

It is also an object of this invention to provide an improved lottery ticket system.

It is another object of this invention to provide an improved system for dispensing completed lottery tickets.

It is another object of the invention to provide an improved lottery ticket terminal for providing completed lottery tickets.

It is another object of this invention to provide an improved lottery ticket vending machine.

These and other objects of the invention are attained generally by providing a lottery ticket having a blank region adapted for having printing thereon information necessary to complete the ticket. In a preferred embodiment, such information is "play data" used to determine the win/lose outcome of the ticket, either "instantly" or at a future date.

In accordance with another feature of the invention, a lottery ticket is provided having a first number concealed with a removable material and a blank region adapted for having printed thereon a second number, the first and second numbers indicating the win/lose outcome of the ticket.

In accordance with another feature of the invention, a method for providing completed lottery tickets comprises the steps of: storing a partially printed, non-completed lottery ticket; providing a terminal coupled to a remotely located computer; and, inserting the non-completed lottery ticket into the terminal and having the terminal communicate with the remotely located computer, the computer supplying to the terminal information necessary for completing the non-completed lottery ticket, such terminal then printing such computer supplied information onto the inserted, non-completed lottery ticket to provide the completed lottery ticket.

With such an arrangement, completed lottery tickets are not stored prior to purchase; but rather, only during purchase is the stored, non-completed lottery ticket printed with information necessary to provide the purchaser with a completed lottery ticket. It this way, if the non-completed tickets are stolen, the thief will not be in possession of completed lottery tickets.

In accordance with another feature of the invention, the non-completed lottery ticket is provided with preprinted information only partially indicative of the win/lose outcome of the ticket. During purchase, the ticket is printed with additional information necessary for the purchaser to then instantly determine the win/lose outcome of the purchased ticket.

In a preferred embodiment of the invention, the non-completed lottery ticket is provided with a pre-printed, concealed "mystery" number and when completed, is printed with at least one other lottery, or "lucky" number. When the concealed number is exposed, as when "rub-off" material concealing such pre-printed number is removed, the purchaser is now able to determine whether the "mystery" number and the lottery "lucky" number match, and therefore whether the ticket is entitled to a prize.

In accordance with another feature of the invention, a lottery ticket terminal is provided for storing non-completed lottery tickets accessible by a purchaser. The terminal has a currency receiver, typically a slot, for receiving payment for a stored ticket. The terminal also has a port, typically a slot, for receiving the stored ticket. When received, a printer in the terminal prints information on the received, non-completed lottery ticket to thereby provide the purchaser with a completed lottery ticket.

In accordance with another feature of the invention, a system is provided for dispensing completed lottery tickets from a vending machine. The vending machine stores partially printed, non-completed lottery tickets. When a lottery ticket is purchased from the vending machine, a printer in the vending machine prints information on the stored, non-completed lottery ticket to thereby provide the purchaser with a completed lottery ticket.

With such an arrangement, the vending machine does not store a completed lottery ticket; but rather, the vending machine prints completed lottery tickets only when such lottery tickets are purchased. In this way, if the vending machine is stolen, the thief will not be in possession of completed lottery tickets.

BRIEF DESCRIPTION OF THE DRAWING

The foregoing features of this invention, as well as the invention itself, may be more fully understood from the following detailed description read together with the accompanying drawings, in which.

DESCRIPTION OF THE PREFERRED EMBODIMENTS

Figure 1:
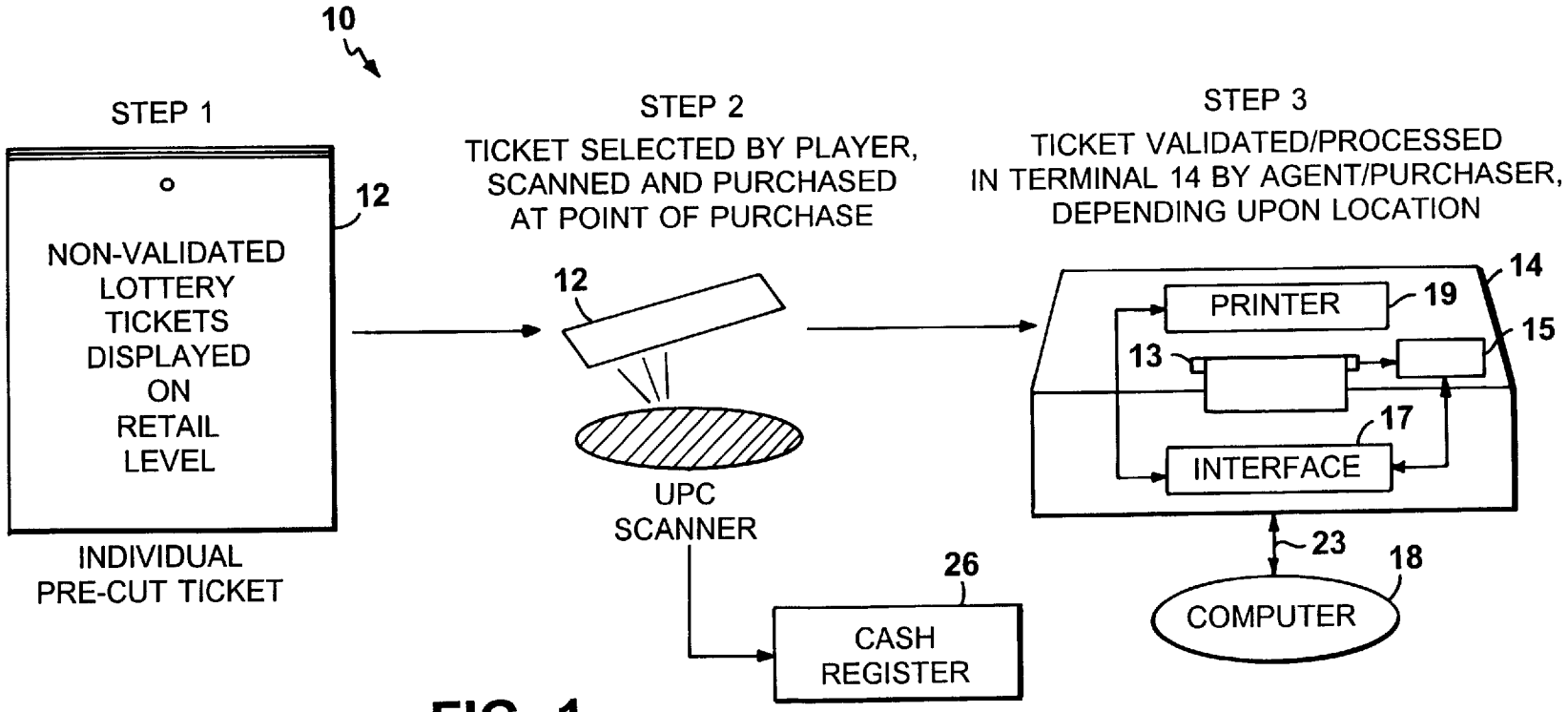
FIG. 1 is a block diagram of a lottery system according to the invention.
Figure 2A:
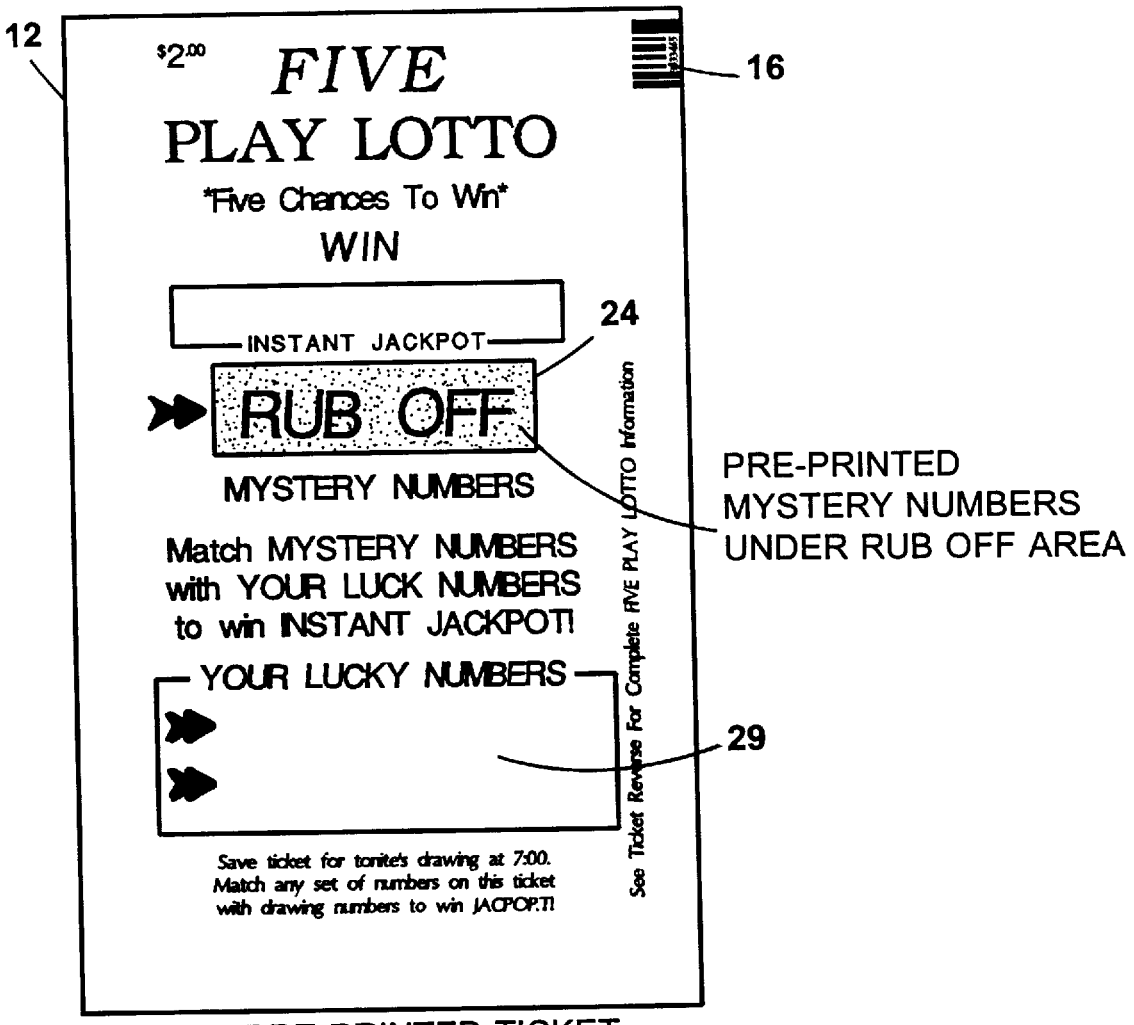
FIG. 2A is a pre-printed non-completed lottery ticket adapted for use in the lottery system of FIG. 1.
Figure 2B:
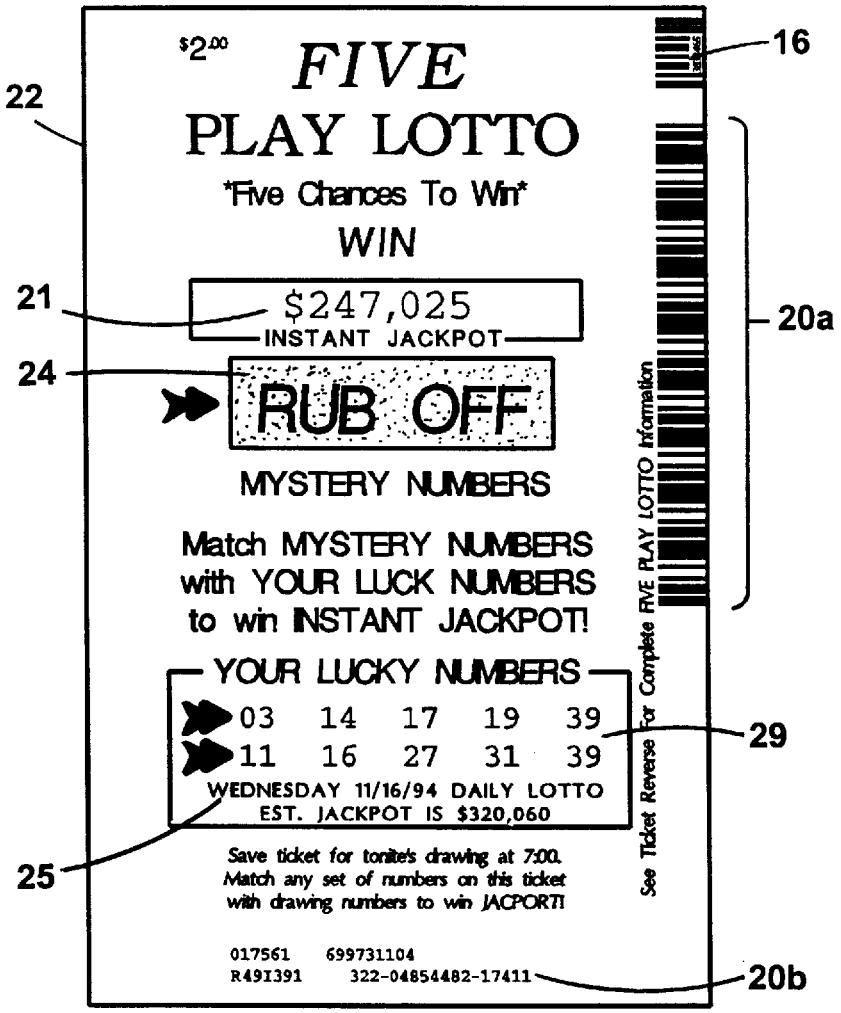
FIG. 2B is the lottery ticket of FIG. 2A after having been completed by the system of FIG. 1 printing information on the ticket necessary to complete the ticket.

Referring now to FIG. 1, a system 10 for providing a completed lottery ticket is shown. A partially printed, non-completed lottery ticket 12, shown more clearly in FIG. 2A, is stored typically near the check-out counter, not shown, of a supermarket or variety store. During the purchase of the non-completed lottery ticket 12 (i.e, either before or after payment), the purchaser, or selling agent, inserts it into a slot 13 provided in a terminal 14. The terminal 14 is typically located behind, or aside of the check-out counter. Upon receipt of non-completed lottery ticket 12 though slot 13, an indication circuit 15 produces a control signal. The indication circuit is of any conventional design which detects that a slip, here the non-completed lottery ticket 12, has been inserted into slot 13. The control signal is fed to a computer-printer interface circuit 17. The interface circuit 17 may be of any conventional design currently used at a counter where lottery tickets are sold over-the-counter at an "on-line" terminal. The interface circuit 17 initiates communication between a remotely located computer 18, here located at an office of the lottery organization, and the printer 19 via telephone line 23. Alternatively, the communication may be by radio (i.e., wireless transmissions) or by cable. The terminal 14 reads a unique bar code 16 (FIG. 2A) pre-printed on the non-completed ticket 12. The read bar code 16 is transmitted to computer 18 via telephone line 23. The computer 18 then supplies "play data" and the necessary information to complete the lottery ticket to terminal 14. The terminal 14 includes a printer 19 which then prints the computer 18 supplied "play data" and ticket completion information onto the non-completed lottery ticket 12 (FIG. 2A) to provide the purchaser with the completed lottery ticket 22 (FIG. 2B).

More particularly, the bar code 16 read by the terminal 14 indicates to the computer 18 the type and exact identity of the purchased ticket. The type of lottery game in this example is a "Five Play Lotto" game. The computer 18 then obtains "play data" and the necessary information to complete the ticket from its database and returns such "play data" and ticket completion information to the terminal 14. Printer 19 of terminal 14 then prints the "play data" 26*a*, 26*b* and ticket completion information 20*a*, 20*b* onto the inserted ticket. Here the ticket completion information is in both a bar code format 20*a* (FIG. 2B) and a human readable format 20*b*, as shown. The terminal 14, after printing the ticket completion information 20*a*, 20*b*, now returns a completed lottery ticket 22, shown more clearly in FIG. 2B, to the purchaser.

Figure 2C:
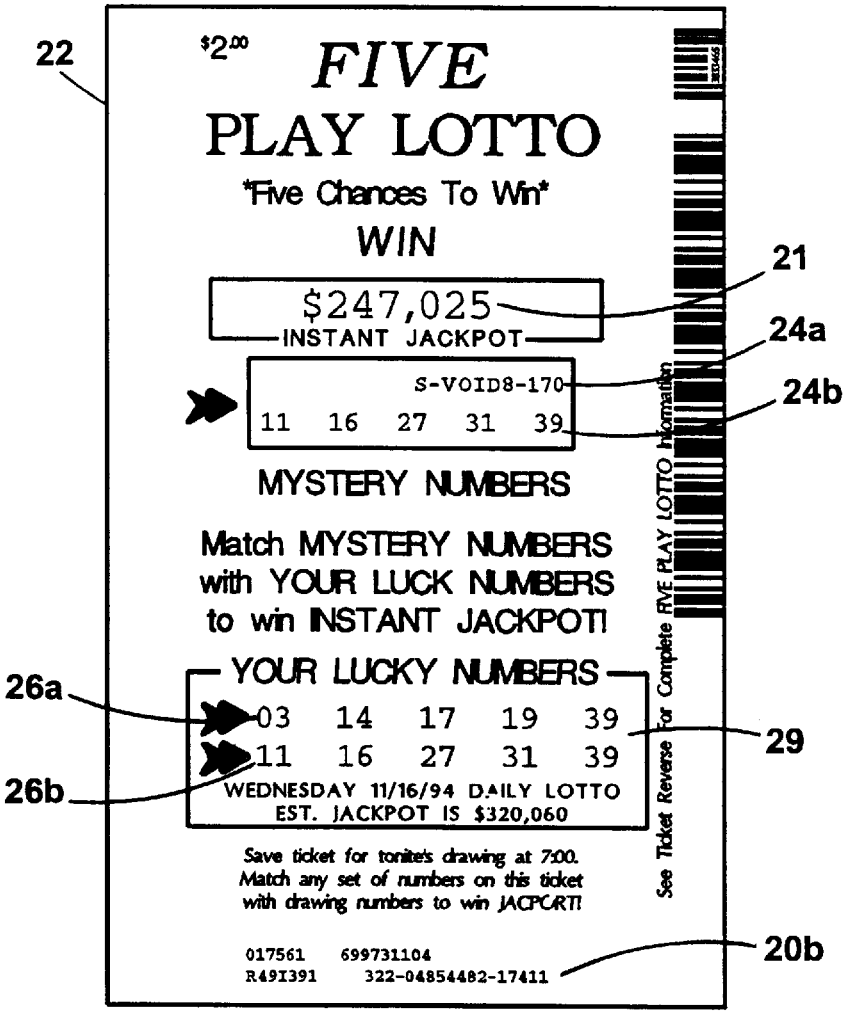
FIG. 2C is the completed lottery ticket of FIG. 2B after a pre-printed concealed "mystery" number has been exposed by removing "rub off" material from such ticket.

More particularly, the non-completed lottery ticket 12 (FIG. 2A) is provided with pre-printed information which only partially indicates the win/lose outcome of the ticket. During purchase (i.e, either before or after payment), the ticket 12 is then printed with additional information (i.e., the "play data" 26*a*, 26*b*) necessary for the purchaser to instantly determine the win/lose outcome of the purchased ticket. More particularly, lottery ticket 12 has a first number, here a "mystery" number concealed with a removable material, here a conventional rub-off material 24 and a blank region 29 adapted for having printed thereon, during purchase, a second number, here the "play data" is a "lucky" number. The first and second numbers indicate the win/lose outcome of the ticket. For example, the non-completed lottery ticket 12 (FIG. 2A) is provided with a pre-printed "mystery" number concealed by "rub-off" material 24. When inserted into terminal 14, the terminal 14 reads the unique ticket serial number encoded into the bar code 16. This read information is transmitted to the computer 18. From the transmitted information, the computer 18 determines, as noted above, the type and exact identity of the ticket. The computer 18 then obtains the remaining "play data" 26, (i.e., here a pair of lottery, or "lucky" numbers 26*a*, 26*b*, as shown) either by accessing file data or by randomly generating the remaining "play data". The remaining "play data" 26*a*, 26*b* (or a lottery number) is then transmitted to the terminal 14 where it is printed onto the blank region 29 of inserted ticket along with the ticket completion information 20*a*, 20*b*. That is, the blank region 29 is printed with the pair of "lucky" numbers. The ticket completion information identifies the terminal 14 along with the date and the time of day the ticket was processed. During this process, the computer 18 compares the original "play data" (i.e, the concealed "mystery number" 24*b* unique to the purchased ticket and known by the computer 18 because of the read code 16) with the transmitted remaining "play data" 26*a*, 26*b* to identify the ticket's win/lose status. If the ticket is a winning ticket, the appropriate file at the lottery organization computer 18 is updated. When the concealed "mystery" number 26*b* is exposed, as when "rub-off" material 24 concealing such pre-printed "mystery" number is removed by the purchaser, as shown in FIG. 2C, the purchaser is now able to instantly determine whether ticket 22 is entitled to a prize. Here, because the exposed "mystery" number 24*b*, "11 16 27 31 39," matches the second "lucky number" 26*b*, the ticket 22 is a prize winning ticket. Here, an "Instant Jackpot" payoff 21 and jackpot drawing date 25 are also printed, as shown in FIG. 2B.

The clerk must then re-insert the ticket 22 into slot 13 of terminal 14 for "prize validation". (It should be noted that ticket completion is the process of completing the non-completed lottery ticket 12 into a complete lottery ticket 22. A competed lottery ticket 22 has been printed with all information necessary to be eligible for redemption by the lottery organization. "Prize" validation occurs when a prize winning completed lottery ticket has been presented to the lottery organization so that the ticket owner may collect his/her prize). Once the purchaser has removed the "rub-off" material"24 and determined that the ticket is a winning ticket, the ticket is re-inserted into slot 13 of terminal 14. When the "rub-off" material 24 is removed, a "prize" validation number 24*a* is also exposed. The bar codes 16 and 20*a* is again read and the clerk key pads in the "prize" validation number 24*a*, both of which are transmitted back to the computer 18 for "prize validation". The computer 18 now knows that the "rub-off" material 24 has been removed. This ensures that the system 10 is not compromised by purchasers trying to "prize validate" tickets prior to removal of the "rub-off" material 24.

Figure 3:
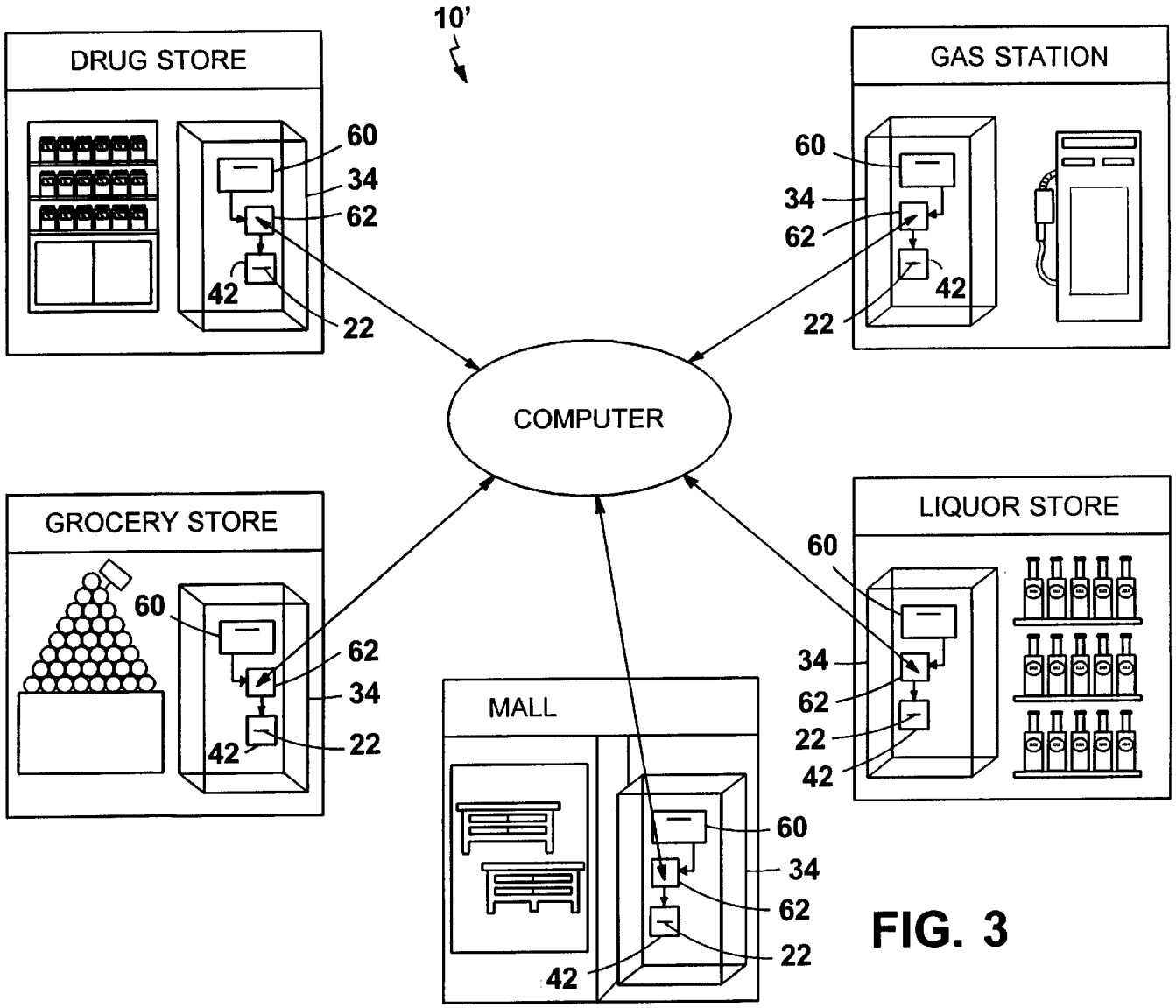
FIG. 3 is a block diagram of a lottery ticket system according to another embodiment of the invention.

Referring now to FIG. 3, a vending machine system 10' for providing the completed lottery tickets 22 (FIG. 2B) is shown. Such system 10' includes the computer 18 at an office of the lottery organization. The system 10' also includes a plurality of vending machines 34 located remotely from the computer 18. The vending machines 34 may be located within a store, here in a drug store, grocery store, gas station, or may be located unattended in a mall kiosk.

Figure 4:
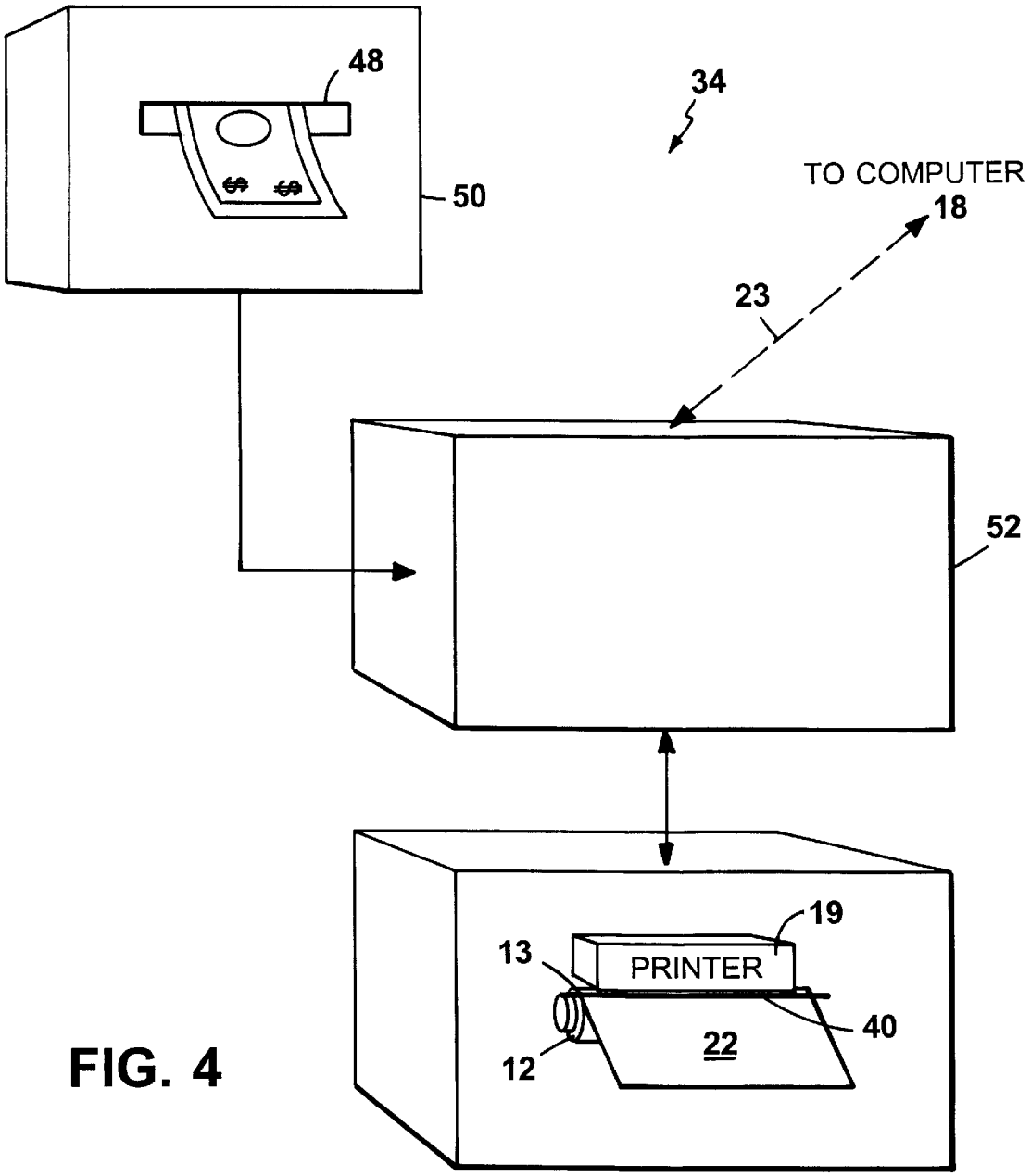
FIG. 4 is a block diagram of portions of one of the lottery ticket vending machines used in the lottery ticket system of FIG. 3.
Figure 5:
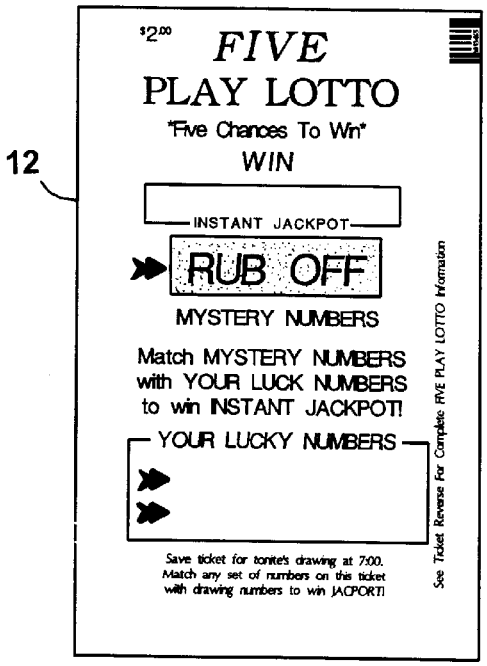
FIG. 5 is a display of single non-completed lottery tickets.
Figure 6A:
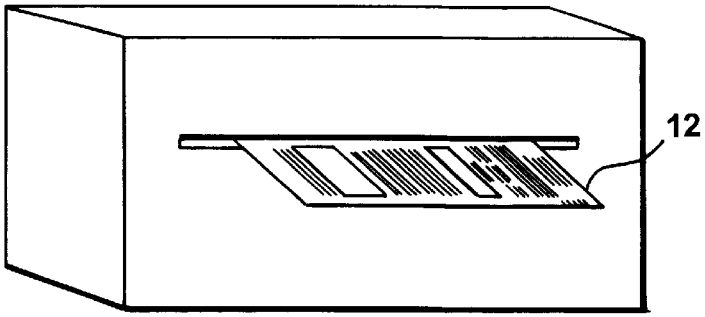
FIGS. 6A and 6B are fan folded non-completed lottery tickets stored in a terminal according to the invention.
Figure 6B:
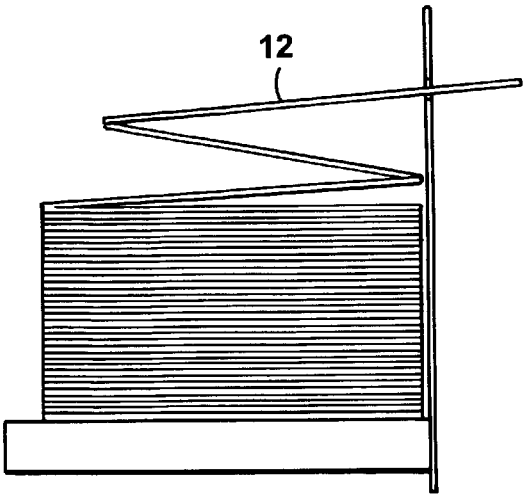

Referring now also to FIG. 4, each one of the vending machines 34 stores therein a printable medium, here a roll of continuous feed ticket stock 38. Alternatively, a fan-folded stack of ticket stock may be used as shown in FIGS. 6A and 6B. The roll, or fan-folded stack of ticket stock 38 provides a continuous series of partially pre-printed, non-completed lottery tickets 12 (FIG. 2A) separated one from another by any conventional means, here, for example, by perforations 40, as shown in FIG. 4. As noted above, the stored, partially pre-printed, non-completed lottery tickets 12 are not the completed lottery tickets 22 in their pre-printed form; but, rather, will only become completed lottery tickets 22 when purchased, in a manner to be described.

Each one of the vending machines 34, or terminals, like terminal 14 (FIG. 1) also includes a printer 19 adapted for coupling to the computer 18 via a telephone line 23, radio, or cable, in a conventional manner, as, for example, the manner currently in use to couple a point-of-sale (i.e., over-the-counter) lottery ticket dispenser to a lottery organization computer 18. The printer 19 may be a continuous feed dot matrix printer, thermal printer, or an ink jet printer. The roll, or fan-folded stack of paper 38, with the partially pre-printed, non-completed lottery tickets 12 (FIG. 2A, are loaded onto the printer 19 in a conventional manner. Thus, as shown in FIG. 4 the non-completed lottery tickets 12 are here of the type described above in connection with FIG. 2A).

Further, each one of the vending machines 34 includes a slot 48 for receiving a form of payment for a completed lottery ticket 22 being purchased. For example, the slot 48 may be adapted to receive currency (i.e., bills or coins), credit card or debit card. Upon receipt of payment of the proper amount for the completed lottery ticket 22 being purchased, a conventional payment indication circuit 50 produces a control signal. The control signal is fed to a computer-printer interface circuit 52. The interface circuit 52 may be of any conventional design currently used at a counter where lottery tickets are sold over-the-counter. Here, however, instead of a clerk pushing a button, for example, to indicate payment of a lottery ticket and thereby initiate communication between a printer/ticket terminal at the counter and the lottery organization computer 18, the control signal produced by the payment indication circuit 50 causes the interface circuit 52 to initiate communication between the computer 18 and the printer 19. Once communication is established, the printer 19 prints information received from the computer 18 to complete the partially pre-printed, non-completed lottery ticket 12 and thereby provide a completed lottery ticket 22 as described above in connection with FIG. 2B. As noted above, each one of the non-completed lottery tickets 12 on the roll, or fan-folded stack of paper 18 may be pre-formed with a conventional "rub-off" material 26 concealing a "mystery" prize, as described above. In such case, the computer would also transmit additional information, such as remaining "play data" 26*a*, 26*b* (i.e., one or more lottery "lucky" numbers) and such additional information would be printed on the ticket 12, as described above. Thus, the vending machines 34 are, like the terminal 14, terminals coupled to the remotely located computer 18.

After purchase and printing, the non-completed lottery tickets 12 are advanced on the roll thereof by printer 19 in a conventional continuous feed manner so that the ticket passes through a lottery ticket dispensing slot 13' provided in the vending machine 14, as shown. The purchaser is thereby able to tear-off the purchased completed ticket 22 passed through slot 13' along the perforations 40 in a conventional manner, remove the "rub off" material, and instantly determine the prize win/lose status of the ticket as described above. Therefore, with system 10', the vending machine 34 does not store, prior to purchase, completed lottery tickets; but rather, the vending machine 34 prints completed lottery tickets only after purchase. In this way, if the vending machine 34 is stolen, the thief will not be in possession of completed lottery tickets 22.

Figure 7:
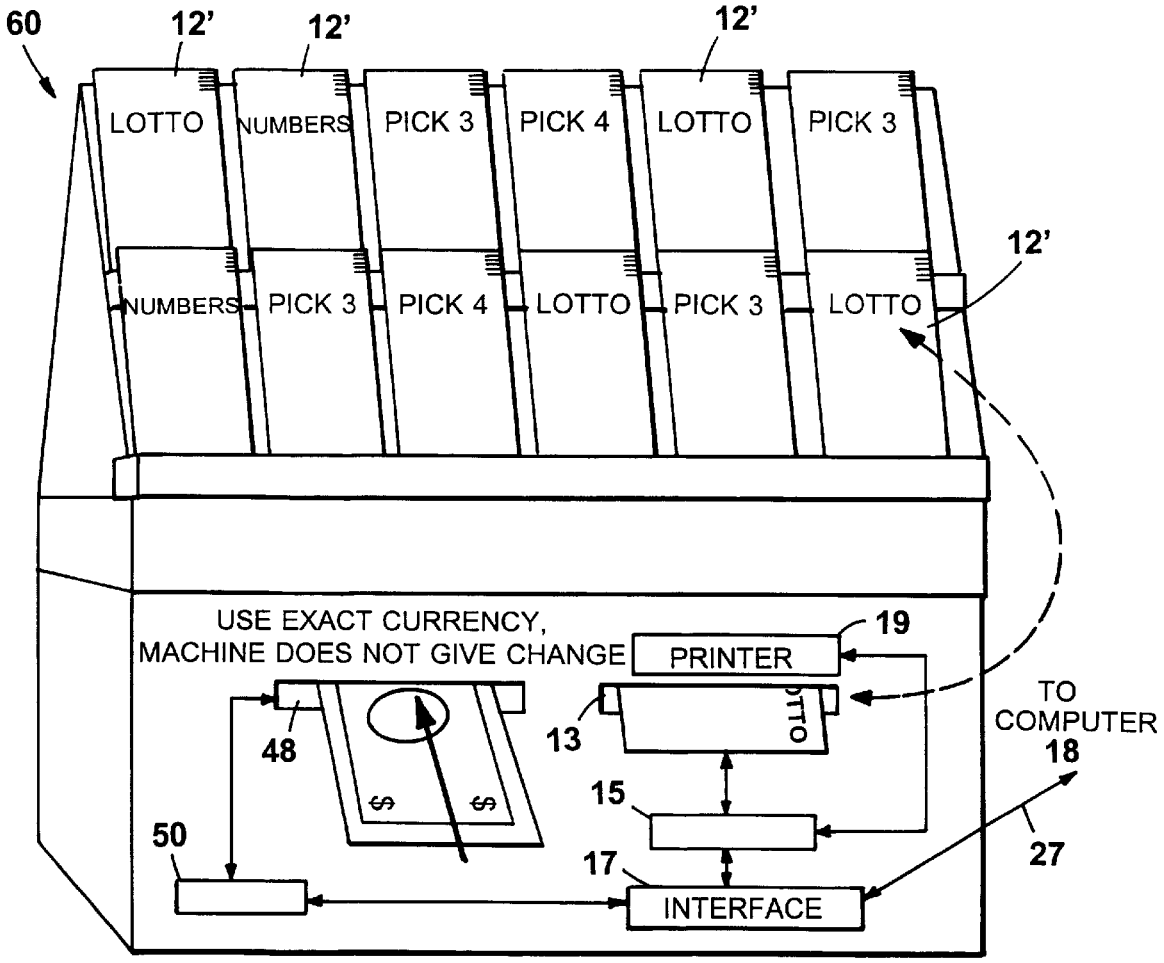
FIG. 7 is a lottery ticket terminal in accordance with an alternative embodiment of the invention.
Figure 8B:
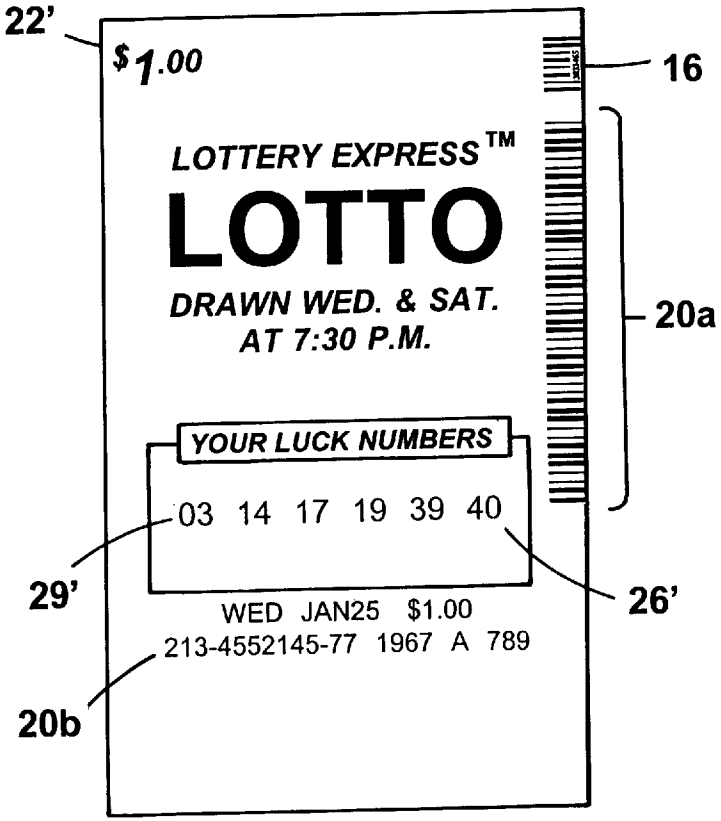
FIG. 8B is the lottery ticket of FIG. 8A after having been completed by the system of FIG. 7 printing information on the ticket necessary to complete the ticket.
Figure 8A:
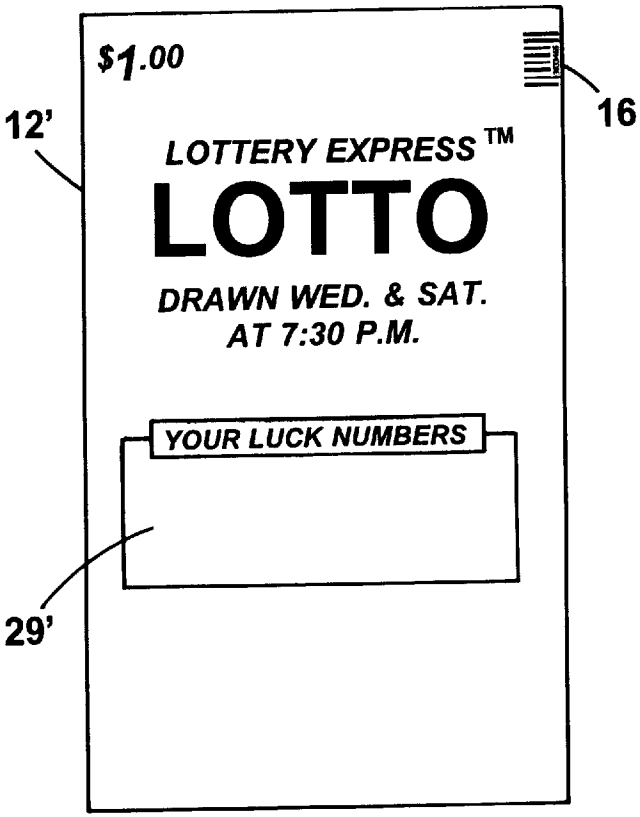
FIG. 8A is a pre-printed non-completed lottery ticket adapted for use in the lottery system of FIG. 7.

Referring now to FIG. 7 a terminal 60 is shown having stacks of different types of non-completed lottery tickets 12'. The tickets 12' are accessible by purchasers. Here tickets 12' are similar to the tickets 12 shown in FIG. 2A except that they do not have a "mystery" number and therefore do not have "rub-off" material 24. They do have the bar code 16 and the blank region 29'. A purchaser selects the desired ticket 12' from the rack and inserts it into slot 13. The bar code 16 is read by indication circuit 15, as described above in connection with FIG. 1. A control signal is produced by circuit 15. The control signal is fed to a computer-printer interface circuit 17. After communication with the lottery organization computer 18, as described above, the computer 18 sends to the interface 17 ticket completion information necessary to provide a completed lottery ticket (i.e., the ticket completion information 20*a*, 20*b*, described above in connection with FIG. 2B) and "play data" 26', here a randomly selected lottery drawing number in blank region 29'. The computer 18 also sends information to the interface 17 which indicates the proper price for the selected ticket. The payment indication circuit 50 provides an indication of the amount of money inserted into slot 48 by the purchaser. If the proper price has been paid, printer 19 prints the ticket completion information 20*a*, 20*b* and the randomly selected lottery drawing information (i.e., the "play data" 26').

Having described a preferred embodiment of the invention, other embodiments will now become readily apparent to those of skill in the art. It is felt, therefore, that the invention should not be restricted to the disclosed embodiments, but, rather, should be limited only by the spirit and scope of the appended claims.

What is claimed is:

1. A method for providing a completed lottery ticket comprising the steps of:

storing a partially printed, non-completed lottery ticket, the lottery ticket having a first area and a second area, one of the first and second areas being concealed, wherein the first area has pre-printed data;

providing a terminal adapted for communication with a remotely located computer; and, inserting the non-completed lottery ticket into the terminal and having the terminal communicate with the remotely located computer, the computer supplying to the terminal information necessary to provide a completed lottery ticket, wherein such supplied information includes supplied data, and such terminal then printing the supplied data onto the second area wherein after said one of the first and second areas being concealed is revealed, such supplied data, if matched with the pre-printed data indicates the ticket as a winning ticket.

2. The method recited in claim 1 wherein the stored, non-completed lottery ticket is provided with a pre-printed, concealed "mystery" number and the additional information supplied by the computer includes at least one "lucky" number and wherein the terminal prints the at least one "lucky" number onto the non-completed lottery ticket, such "lucky" number, if matched with the "mystery" number indicates the ticket as a winning ticket.

3. The method recited in claim 1 wherein the stored lottery ticket has printed thereon a unique ticket bar code number and wherein the terminal reads such printed serial number and communicates the read bar code number to the computer.

4. The method recited in claim 3 wherein the computer provides the information to the terminal in response to the read serial number.

5. The method of claim 1, further comprising the step of:

updating information in the remotely located computer in response to a winning ticket.

6. The method of claim 1 wherein the first area is concealed.

7. A method for providing a lottery ticket comprising the steps of:

storing a lottery ticket having printed thereon only a portion of data necessary to determine a win/lose outcome of the ticket, the lottery ticket having a first area and a second area, one of the first and second areas being concealed, wherein the first area has pre-printed data;

providing a terminal adapted for communication with a remotely located computer; and, inserting the lottery ticket into the terminal and having the terminal communicate with the remotely located computer, the computer then supplying to the terminal additional data and such terminal then printing such computer supplied additional data onto the second area of the inserted lottery ticket to provide the ticket with sufficient information to determine the win/lose outcome of the ticket wherein after said one of the first and second areas being concealed is revealed, the computer supplied additional data, if matched with the pre-printed data indicates the ticket as a winning ticket.

8. The method recited in claim 7 wherein the stored lottery ticket has printed thereon a unique ticket serial number and wherein the terminal reads such printed serial number and communicates the read serial number to the computer.

9. The method recited in claim 8 wherein the portion of the data on the stored ticket is a concealed number.

10. The method recited in claim 9 wherein the computer provides the additional data to the terminal in response to the read serial number and wherein the terminal prints the additional data on the inserted ticket.

11. The method recited in claim 10 wherein the stored lottery ticket has removable material disposed over the concealed number.

12. The method of claim 7 further comprising the step of:

updating information in the remotely located computer in response to a winning ticket.

13. The method of claim 7 wherein the first area is concealed.

14. A method for providing completed lottery tickets from a vending machine comprising the steps of:

printing data, at the vending machine, on a purchasable lottery ticket disposed in the vending machine to provide a printed lottery ticket, the lottery ticket having a first area and a second area, one of the first and second areas being concealed, wherein the first area has pre-printed data, the printed data being printed onto the second area wherein after said one of the first and second areas being concealed is revealed, such printed data, if matched with the pre-printed data indicates the ticket as a winning ticket, and such printed data being printed in response to such vending machine receiving an indication that a lottery ticket is being purchased from the vending machine, such information completing the purchased lottery ticket and;

dispensing such printed lottery ticket from the vending machine.

15. The method of claim 14 wherein a remotely located computer supplies the data printed onto the second area of the lottery ticket.

16. The method of claim 15 further comprising the step of:

updating information in the remotely located computer in response to a winning ticket.

17. The method of claim 14 wherein the first area is concealed.

18. A system for providing completed lottery tickets, comprising:

a printable medium having pre-printed thereon a portion of a lottery ticket, such pre-printed lottery ticket being a non-completed lottery ticket having a first area and a second area, one of the first and second areas being concealed, wherein the first area has pre-printed data;

a printer adapted to print on the printable medium; and means for enabling the printer to print, when the non-completed lottery ticket is purchased, additional material onto the second area of the pre-printed printable medium to convert the printable medium into the completed lottery ticket, wherein such additional material includes data and wherein, after said one of the first and second areas being concealed is revealed, such additional data, if matched with the pre-printed data indicates the ticket as a winning ticket.

19. The system recited in claim 17 wherein the printed information includes date and time of ticket purchase.

20. The system of claim 18 wherein a remotely located computer supplies the data printed onto the second area of the lottery ticket.

21. The system of claim 20 wherein the enabling means further comprises means for communicating, in response to a winning ticket, with the remotely located computer to update information in the remotely located computer.

22. The system of claim 18 wherein the first area is concealed.

23. A system for providing completed lottery tickets, comprising:

(a) a computer;

(b) a printable medium adapted to provide a lottery ticket, the printable medium having pre-printed thereon a portion of a lottery ticket, such pre-printed lottery ticket being a non-completed lottery ticket having a first area and a second area, one of the first and second areas being concealed, wherein the first area has pre-printed data;

(c) a printer adapted for coupling to the computer and adapted to print data, when a lottery ticket is purchased, from the computer on the printable medium in response to signals coupled to the printer from the computer;

(d) means for enabling the printer to print the data from the computer onto the second area of the printable medium to provide a completed valid lottery ticket, wherein after said one of the first and second areas being concealed is revealed, such data, if matched with the pre-printed data indicates the ticket as a winning ticket.

24. The system recited in claim 18 wherein the printed information includes a lottery number.

25. The system recited in claim 23 wherein the first area is a "rub-off" region and the pre-printed data includes a number disposed under the "rub-off" region.

26. The system of claim 23 wherein the computer is a remotely located computer.

27. The system of claim 26 wherein the enabling means further comprises means for coupling, in response to a winning ticket, with the remotely located computer to update information in the remotely located computer.

28. The system of claim 15 wherein the first area is concealed.

29. A method for providing a completed lottery ticket from a vending machine comprising the steps of:

storing in the vending machine a partially printed, non-completed lottery ticket, the lottery ticket having a first area and a second area, one of the first and second areas being concealed, wherein the first area has pre-printed data; and, completing the non-completed lottery ticket when a lottery ticket is purchased from the vending machine, by printing additional data onto the second area, wherein after said one of the first and second areas being concealed is revealed, such additional data, if matched with the pre-printed data indicates the ticket as a winning ticket.

30. The method recited in claim 29 wherein the step of completing includes the step of receiving ticket completion information from a remotely located computer.

31. The method of claim 29 wherein a remotely located computer supplies the data printed onto the second area of the lottery ticket.

32. The method of claim 31 further comprising the step of:

updating information in the remotely located computer in response to a winning ticket.

33. The method of claim 29 wherein the first area is concealed.

* * * * *